United States Patent [19]

Perevozkin et al.

[11] Patent Number: 4,853,047

[45] Date of Patent: Aug. 1, 1989

[54] WORK-PERFORMING MEMBER FOR FARM MACHINES

[75] Inventors: Jury L. Perevozkin; Jury A. Gajun; Petr K. Grigorov; Vasily M. Zhurakovsky; Boris V. Samelik, all of Rostov-na-Donu, U.S.S.R.

[73] Assignee: Nauchno-Proizvodstvennoe Obiedinenie Po Tekhnologii Mashinostroenia Dlya Zhivotnovodstva I Kormoproizvodstva "RostNIITM", Rostov-na-Donu, U.S.S.R.

[21] Appl. No.: 198,998

[22] PCT Filed: Aug. 25, 1986

[86] PCT No.: PCT/SU86/00081

§ 371 Date: Apr. 8, 1988

§ 102(e) Date: Apr. 8, 1988

[87] PCT Pub. No.: WO88/01655

PCT Pub. Date: Mar. 10, 1988

[51] Int. Cl.[4] ..... C22C 38/36

[52] U.S. Cl. ..... 148/905; 148/902; 148/324; 148/321

[58] Field of Search ..... 177/747; 76/82; 148/902, 905, 324, 321; 420/10, 15, 11

[56] References Cited

U.S. PATENT DOCUMENTS

| | | | |
|---|---|---|---|
| 2,204,283 | 6/1940 | Potts et al. | 148/905 |
| 2,719,353 | 10/1955 | Mills | 172/747 |
| 3,224,179 | 12/1965 | Schuman | 56/310 |
| 3,716,978 | 2/1973 | Haban | 56/310 |
| 4,711,676 | 12/1987 | Kitaori et al. | 148/902 |

FOREIGN PATENT DOCUMENTS

| | | | |
|---|---|---|---|
| 467065 | 6/1937 | United Kingdom | 148/905 |

OTHER PUBLICATIONS

Povyshenie Iznosostoilosti I Dolgovechnosti Rezhuschikh Elementov Selskokhozyaistvennykh Mashing.

*Primary Examiner*—Deborah Yee
*Attorney, Agent, or Firm*—Ladas & Parry

[57] ABSTRACT

The work-performing member for a farm machine has a cutting edge made of a high-carbon steel containing graphite in structurally free state in an amount of 0.5 to 1.32 percent of the total mass of the material.

2 Claims, No Drawings

WORK-PERFORMING MEMBER FOR FARM MACHINES

FIELD OF THE INVENTION

The present invention relates to engineering of parts of machinery, such as parts and components of agricultural or farm machines, and more particularly it relates to engineering of the work-performing members of agricultural or farm machines.

The invention can be utilized to the utmost effect in the manufacture of grass rods and segments of the cutting units of various mowers and reapers for harvesting grain, grass and stem crops, of colters and blades of sheep shearers, and of other like parts and components.

Background of the Invention

The working conditions of the work-performing members of farm machines are characterized by the combined effect of various impact loads and intense abrasion wear of the cutting edges. Therefore, in order to avoid breakdowns of the work-performing members and prevent their cutting edges from getting blunt, more often than not such members are assembled of several components, e.g. of the main component made of either medium-carbon or low-alloy structural steels offering high mechanical properties, and of cutting elements made of high-carbon tool steels offering adequately high hardness, joined to the main component by riveting, welding, soldering or like techniques. However, this practice complicates the manufacture of a work-performing member and raises its production cost, to say nothing of the area of the joining of the components being prone to breakdowns. Thus, detachment of a riveted counter-cutting plate from the grass rods or fingers of a cutting unit is among the most frequent causes of cutting unit breakdowns.

For this reason the recently spreaded practice is to manufacture and use solid or integral work-performing members of farm machines. In most cases these work-performing members are made of medium-carbon steel grades by hot stamping or forging (see, for example U.S. Pats. Nos 2,719,353; Cl. 29–148, or 3,716,978; Int.Cl. A01d 55/10). After the forming of a part and its machining, the cutting edge is hardened by induction, hardening yielding a hardness of about HRC 50—55 (Rockwell Scale 'C' hardness).

However, work-performing members thus manufactured have relatively low hardness and wear resistance of their cutting edges; furthermore, their manufacture involves the use of complicated forming equipment and labor-consuming operations, with production of serrated or toothed working edges being virtually impossible.

In some cases, to simplify the forming process, the work-performing members are made of low-carbon steel grades with subsequent carburizing or carbonitriding. However, this complicates the manufacturing technology and makes it more costly, while failing to adequately enhance the wear resistance of a cutting edge on account of the relatively small depth of the carburized layer.

There is also known the use of cast work-performing members of farm machines, made of malleable perlite cast iron (see, for example, U.S. Pat. No. 3,224,179; Cl. 56–310). Following the casting and annealing steps, the cutting edges of work-performing members are hardened by induction hardening. In this way the manufacturing process of such parts can be simplified and made less costly, and it is possible to produce serrated or toothed cutting edges.

However, the inadequate impact strength of the material has been found to lead to not infrequent cases of breakdowns of the work-performing members, while the relatively low hardness after the hardening (about HRC 50) would not ensure sufficient wear resistance of a cutting edge.

SUMMARY OF THE INVENTION

It is therefore an object of the present invention to provide the work-performing member for a farm machine, which would offer enhanced wear resistance of the cutting edge owing to the altered structure of the material, with the manufacturing technology of the work-performing member being simultaneously simplified.

This object is attained in a work-performing member for a farm machine, having its cutting edge made of a material which is basically a high-carbon steel which, in accordance with the invention, includes graphite in a structurally free state, in an amount of 0.5 to 1.32 percent of the total mass of the material.

This provides for significantly enhanced wear resistance of the cutting edge of the work-performing member of a farm machine.

The wear resistance of the cutting edge is enhanced still further, in accordance with a further feature of the present invention, when the high-carbon steel of the cutting edge additionally includes chromium carbides.

The work-performing member for farm machines, manufactured in acordance with the present invention will be further described in connection with its embodiments in greater detail.

BEST MODE OF CARRYING OUT THE INVENTION

The disclosed work-performing member for farm machines is made of a high-carbon steel including graphite in a structurally free state in an amount of 0.5 to 1.32 percent of the total mass of the material.

Owing to the significant percentage of the carbon in this steel being in the form of structurally free graphite, the main material of the work-performing member has the structure of a medium-carbon structural steel with fine globular inclusions of graphite, which would not impair the mechanical properties of the material any noticeably.

When the cutting edge of the work-performing member is subsequently heated for hardening, the graphite therein becomes partly dissolved, and the content of carbon in the cutting edge becomes higher than the carbon content of the main material of the work-performing member, which provides for obtaining adequately high hardness of the surface or skin layer of the cutting edge, so that the wear resistance thereof becomes enhanced. Moreover, the wear resistance of the cutting edge is additionally enhanced, owing to the presence in its surface of the remaining structurally free graphite.

Table 1 below presents comparative properties of six samples of the material for work-performing members for farm machines, related to the content therein of structurally free graphite.

TABLE 1

| Sample No. | Graphite content in material, % | Tensile strength, kg/mm$^2$ | Impact strength, kg m/cm$^2$ | Hardness of hardened layer, HRC |
|---|---|---|---|---|
| 1 | 0.45 | 79.0 | 11.4 | 64 |
| 2 | 0.51 | 78.2 | 16.0 | 63 |
| 3 | 0.87 | 76.8 | 18.1 | 59 |
| 4 | 1.22 | 73.4 | 18.6 | 55 |
| 5 | 1.30 | 72.0 | 16.5 | 54 |
| 6 | 1.36 | 67.3 | 14.0 | 49 |

It can be seen from the data in Table 1 above that with the material containing structurally free graphite in an amount in excess of 1.32% of the total mass of the material, the hardness of the cutting edge falls below the permissible level, while the mechanical properties of the material are also impaired. On the other hand, with the content of structurally free graphite below 0.5% of the total mass of the material, its impact strength is significantly reduced. Therefore, it is expedient to select the content of structurally free graphite in the material for work-performing members for farm machines from a range of 0.5 to 1.32 percent of the total mass of the material.

The wear resistance of the cutting edge of a work-performing member for farm machines can be further enhanced by forming therein chromium carbides in an amount of 3.0 to 20.0 percent of the total mass of the material, by saturating by diffusion its surface layer or skin with a chromium-containing substance. Owing to the presence in the material of the cutting edge of graphite in a structurally free state, the process of obtaining an alloyed layer is intensified, with the thickness of the alloyed layer being increased and the concentration therein of chromium carbides also rising, whereby the wear resistance of the cutting edge becomes enhanced.

Carbon contained in a free state in the structure of the material readily reacts in the range of the elevated heating temperatures with active chromium, yielding carbides, mostly $Cr_7C_3$, which become active centres of further adsorption of chromium. Consequently, a compact carbide-containing layer of substantial thickness is formed at the surface of the cutting edge, with pinholes or surface areas devoid of the alloyed skin being completely absent. Furthermore, it becomes possible to obtain the required thickness and composition of the alloyed skin layer while reducing the temperature and curtailing the time of the alloying operation. Table 2 below indicates the thickness of the alloyed layer on the surfaces of samples, related to the content therein of structurally free graphite, and to the temperature and duration of the alloying operation.

TABLE 2

| Sample No. | Graphite content in material | Thickness of alloyed layer, mkm | | | | | |
|---|---|---|---|---|---|---|---|
| | | Heating to 900° C., h | | | Heating to 1000° C., h | | |
| | | 2 | 4 | 12 | 2 | 4 | 12 |
| 1 | — | 2 | 5 | 10 | 8 | 12 | 20 |
| 2 | 0.68 | 7 | 14 | 18 | 16 | 22 | 35 |
| 3 | 0.79 | 6 | 13 | 19 | 16 | 21 | 34 |
| 4 | 0.89 | 7 | 13 | 19 | 16 | 21 | 36 |

It can be seen from the data in Table 2 that the presence in a sample of structurally free graphite allows for reducing the temperature and curtailing the time of the alloying operation, required for obtaining an alloyed layer of a desired thickness.

TABLE 3

| Nos of samples of cutting pairs | Content of chromium carbide in material, % of total mass of material | Number of sheep sheared without resharpening the cutting pairs |
|---|---|---|
| 1 | — | 7 |
| 2 | 1.5 | 8 |
| 3 | 2.0 | 10 |
| 4 | 2.7 | 13 |
| 5 | 3.0 | 18 |
| 6 | 5.6 | 20 |
| 7 | 10.8 | 21 |
| 8 | 15.1 | 23 |
| 9 | 18.2 | 22 |
| 10 | 20.0 | 24 |

Table 3 above summarizes the results of a wear resistance test of the work-performing member of a sheep shearer, made of a material containing graphite in a structurally free state, in an amount of 0.5 to 1.32 percent of the total mass of the material, related to the content of chromium carbides in the skin-hardened layer of the respective components of the work-performing member. The maximum possible content of chromium carbides in the material is 20% of the total mass of the material. It can be seen from these data that the wear resistance sharply rises when the chromium carbide content grows to 3%, and when the chromium carbide concentration grows even higher, the wear resistance rises but slowly. Thus, the optimized range of the chromium carbide content can be defined from 3.0 to 20.0 percent of the total mass of the material..

INDUSTRIAL APPLICABILITY

Thus, with work-performing members for farm machines being manufactured of a high-carbon steel containing graphite in a structurally free state, their wear resistance and performance reliability can be substantially enhanced.

These ratings are enhanced still further when structurally free graphite in the main material is combined with thermodiffusion saturation of the surface of an article with chromium. In this case the presence of structurally free graphite has been found to intensify the surface alloying process, i.e. to make the manufacturing, technology amenable to simplification owing to a substantial reduction of the heating temperature and curtailing of the operation time.

Simplification of the manufacturing technology and reduction of the manufacturing cost can be extended by manufacturing work-performing members for farm machines by the foundry technique, i.e. by casting without subsequent machining. annealing and carburizing. The disclosed work-performing member can be produced of any required shape, serrated or toothed cutting edges included, so that the overall weight of the work-performing member can be reduced and the input of metal into its manufacture can be minimized.

I claim:

1. A work-performing member for a farm machine, having its cutting edge made of a high-carbon steel, characterized in that this steel contains graphite in a structurally free state, the amount of said graphite thus contained being from 0.5 to 1.32 percent of the total mass of the material.

2. A work-performing member for a farm machine as claimed in claim 1, characterized in that the high-carbon steel of its cutting edge additionally contains chromium carbides in an amount from 3.0 to 20.0 percent of the total mass of the material.

* * * * *